United States Patent [19]

Scourtes et al.

[11] Patent Number: 4,616,800

[45] Date of Patent: Oct. 14, 1986

[54] SWIMMING POOL BOND BEAM FORM SYSTEM

[76] Inventors: Constantine C. Scourtes; Ralph A. Doerfling, both of 9602 Morris Bridge Rd., Tampa, Fla. 33617

[21] Appl. No.: 682,418

[22] Filed: Dec. 17, 1984

[51] Int. Cl.[4] ..... E04B 1/16

[52] U.S. Cl. ..... 249/4; 4/510; 249/8; 249/83; 249/96; 249/208; 249/DIG. 3

[58] Field of Search ..... 249/DIG. 3, 1-8, 249/10, 18, 19, 14, 26, 27, 83, 96, 207, 208, 219 R; 264/34, 35; 52/169.7, 102; 4/506, 510, 512, 513

[56] References Cited

U.S. PATENT DOCUMENTS

| | | | |
|---|---|---|---|
| 2,178,535 | 10/1939 | Willson | 249/15 |
| 2,250,839 | 7/1941 | Perry | 249/2 |
| 2,260,447 | 10/1941 | Forbes | 249/8 |
| 2,965,950 | 12/1960 | Wilson | 249/208 |
| 3,072,921 | 1/1963 | Hegerfeld | 264/35 |
| 3,157,098 | 11/1964 | Mason | 264/31 |
| 3,452,495 | 7/1969 | Schroeder | 52/102 |
| 3,987,997 | 10/1976 | Stegmeier | 249/DIG. 3 |

*Primary Examiner*—Jay H. Woo
*Assistant Examiner*—James C. Housel
*Attorney, Agent, or Firm*—Pettis & McDonald

[57] ABSTRACT

A system of forms for pouring a concrete bond beam, curb and gutter in the construction of a concrete swimming pool to have waterline and curb tiles in place. A set of form boards is provided which define the bond beam waterline, gutter line and curb line. Each form board includes a panel of styrofoam rabbetted to temporarily hold, by means of adhesive tape, a plurality of tiles. The form boards are maintained in a preselected spacing by a plurality of transverse support frames temporarily attached to the form boards. Concrete is poured into the assembled forms to form the bond beam having a gutter and curb, and adheres to the back of the tiles. Upon removal of the form system, the bond beam with attached tiles is ready for finishing. The form system is reusable.

8 Claims, 5 Drawing Figures

SWIMMING POOL BOND BEAM FORM SYSTEM

BACKGROUND OF THE INVENTION

1. Field of the Invention

The present invention relates to the construction of swimming pools and more particularly to a form system for constructing the gutter and bond beam portion of a swimming pool.

2. Description of the Prior Art

The present invention is concerned with construction of permanent swimming pools which are formed by excavating a hole into the ground having the shape and contours required for the pool. Reinforcing steel is placed in the hole and sprayed with concrete to thereby form a concrete bottom and sidewalls. Additionally, a bond beam is formed around the upper peripheral portion of the pool which may also form a bed for a curb or deck. The bond beam may be formed integral with the sidewalls or may be formed later in which case reinforcing steel is left projecting from the sidewall which is then tied into the reinforcing steel for the bond beam. After completion of the bond beam, it is common to install ceramic tile around the upper pool wall periphery and the curb portions of the bond beam.

Most pools include a scum gutter construction around the periphery of the pool just above the water line. The gutter is provided with drains spaced along its length which connect to a gutter drain line. Typically, after pouring of the concrete for the bond beam, workers must manually form the gutter to have the proper profile with trowels. After the concrete has cured, each tile must be then set by hand and thereafter the gutters and interior surfaces of the pool coated with a finish concrete coat. A major cost factor in such conventional construction of the bond beam portion of a swimming pool is the labor for forming the gutters to the proper profile and for installing the ceramic tile after the concrete has cured. The construction and tiling of the bond beam and gutters is also the most time consuming phase of pool construction and often requires over 80% of the total time of construction. There is, therefore, a need for a system which will reduce the labor of tiling, the time to construct the bond beam, and therefore, the cost.

SUMMARY OF THE INVENTION

The present invention is a form system for forming the bond beam portion of a swimming pool with all tile in place eliminating the requirement for tile setters and greatly reducing the manual labor formerly required. The invention contemplates the forming of the swimming pool sidewalls in conventional fashion by spraying of concrete mixtures over steel reinforcements with vertical rods of the reinforcing mats left projecting several feet above the ground level. As will be described hereinafter, reinforcement rods in the bond beam will be tied to these projecting rods.

After completion of the concrete pool bottom and sidewalls, the gutter drain lines are installed around the periphery of the pool and connected back to the water circulation system. Riser pipes are installed, at the locations selected for the gutter drains, which will generally extend a few feet vertically above the ground surface. The reinforcing bars for the bond beam may now be installed around the periphery of the pool and tied into the reinforcement rods projecting from the sidewalls.

After the pool sidewall concrete has cured, a set of forms in accordance with the invention is erected around the periphery of the pool. Generally, the forms include a multiplicity of frames disposed above the required bond beam height and at right angles to the pool walls. A plurality of elongate form boards is attached to the frames and disposed parallel with the pool walls. An inner waterline form board is disposed along the upper edge of the pool wall, a second inner curb line form board is disposed along the line of the desired curb and an outer curb line form board is disposed at the desired location of the outer curb line with each form board secured to and held in place by the lateral frames. Stakes may be driven in the ground along the other surfaces of the outer curb form board to provide additional support.

It is desired to have a set of waterline ceramic tiles, a set of inner curb tiles and a set of outer curb tiles. To this end, a novel structure for installing the tiles along with the form boards is used. The form system involves the use of auxiliary styrofoam panels associated with each form board. For example, a sheet of styrofoam having a thickness determined by the thickness of the tiles is attached to one surface of the waterline form board by means of staples or nails. A longitudinal rabbet is cut into the styrofoam board having a width approximately the same as the height of the water line tiles. A strip of double sided adhesive tape is applied to the face of the rabbeted area of the styrofoam board and the waterline tiles installed along the styrofoam panel with the finished surface attached to the outer surface of the double sided adhesive tape. The tiles are spaced as required for subsequent grouting. As will be understood the finished surface of the tile will be facing toward the pool.

In similar fashion, a rabbeted styrofoam panel is attached to the outer surface of the inner curb form board and the inner curb tiles fastened along the rabbeted portion thereof with the finished sides facing toward the pool. A styrofoam board is attached to the inner surface of the outer curb form board and the outer curb tiles attached to the inner surface of the styrofoam.

After installation of the drain plumbing, the reinforcing steel and the form system, concrete is poured in between the outer curb form and the waterline forms which will provide a concrete surface up to the top edge of the waterline tile forming the gutter area. As will be understood, the wet concrete will contact the back surface of the waterline tiles as it is poured and will adhere thereto. As filling continues, the concrete will then fill the space between the inner curb form and tiles and the outer curb form and tiles and is continued until the concrete surface is just below the upper edge of these tiles. The concrete therefore contacts the back surfaces of the inner curb tiles and the outer curb tiles and will adhere thereto. The forms are constructed such that the surface of the concrete between the curb line form and the inner curb form slopes downward and outward thereby forming a suitable gutter surface.

After the bond beam is completely poured and cured, the frames and form boards are removed with the result that the bond beam is in place complete with all facing tiles. The finish concrete may then be installed on the pool sidewalls and bottom and along the formed gutter areas. The space between the inner curb tiles and the outer curb tiles may be finished with any type of desired surface such as a non-skid deck surface. Grout is installed between the tiles and other finish work is performed.

It is to be understood that the form frames and form boards are prefabricated and are assembled using bolts and removable nails or staples. Thus upon dismantling, the form system of the invention is available for future construction. The styrofoam panels are removed from the form boards and discarded after use and new panels prepared for the next job. As will be understood, these panels are cut and rabbetted to suit the size and thickness of the tiles for the particular job.

It is therefore a principal object of the invention to provide a novel form system for swimming pools which permits the bond beam to be poured and the waterline and curb tiles installed in one operation.

It is another object of the invention to provide a form system which can be quickly installed and removed from a swimming pool under construction, which will reduce the time of construction, and which is reusable.

It is still another object of the invention to provide a form system for a swimming pool which will eliminate much of the labor of individually installing curb and waterline tiles.

It is a further object of the invention to provide a form system for a swimming pool which simplifies the installation of the gutter and drain system of the swimming pool and which will minimize the labor of forming the drain gutters.

These and other objects and advantages of the invention will become apparent from the following detailed description when read in conjunction with the drawings.

DETAILED DESCRIPTION OF THE PREFERRED EMBODIMENT

Figure 1:
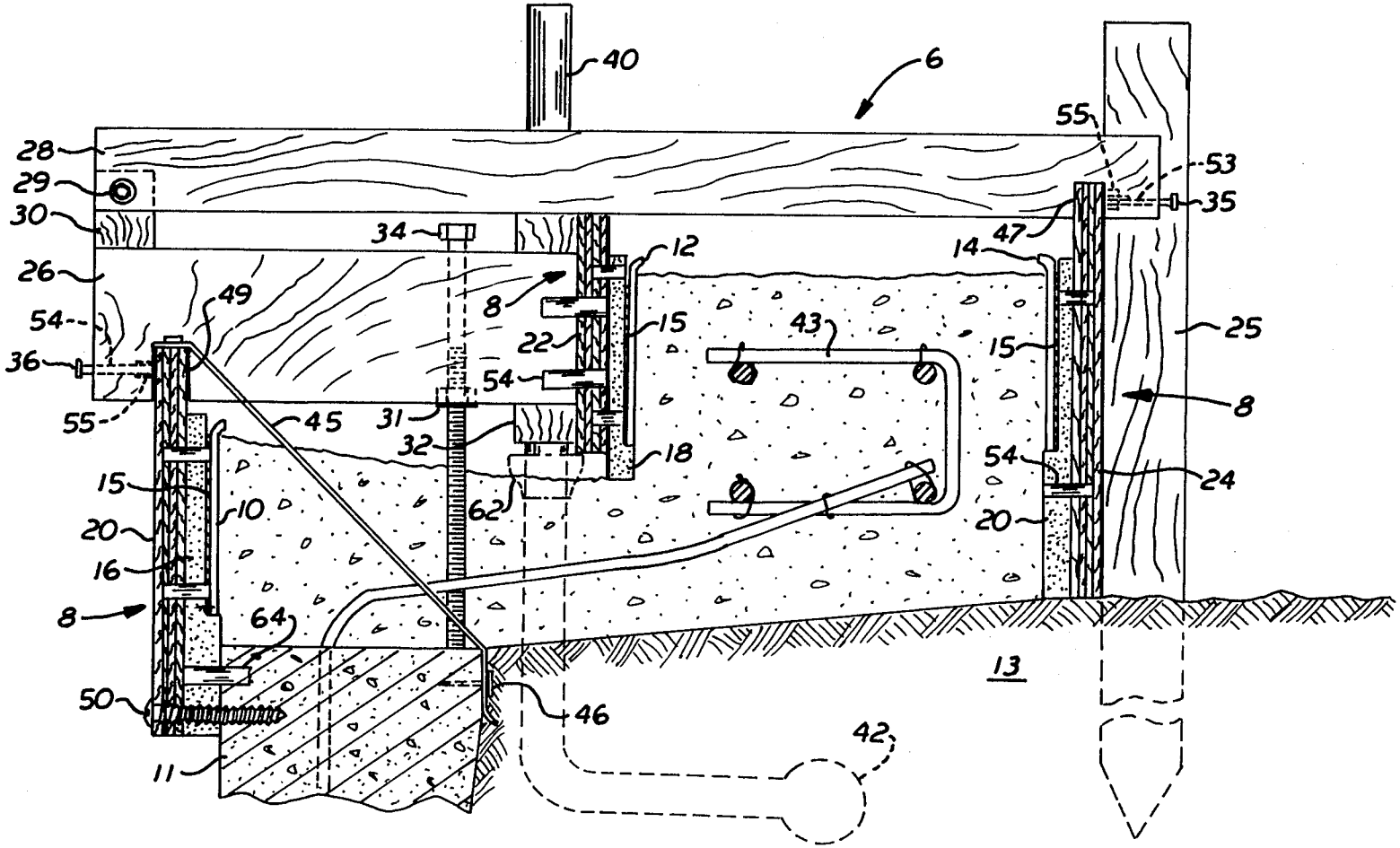
FIG. 1 is a cross-sectional view of a portion of a swimming pool showing the form system of the invention installed and the bond beam poured therein.

Referring to FIG. 1, a cross-sectional view of the form system of the invention is shown. As shown in the figure, the form system is in place and the bond beam 5 has been poured. Prior to pouring of bond beam 5, swimming pool sidewall 11 was poured and permitted to cure. As will be seen, a typical reinforcing rod 41 which is a part of the reinforcing rod system for sidewall 11 projects therefrom and is bent outward.

A gutter drain line 42 shown in phantom view is buried in ground 13 and a drain pipe 40 is connected thereto and projects upward from the ground 13. Although not indicated in FIG. 1, it is preferred that drain pipe 40 be cut off prior to pouring of concrete bond beam 5 and drain fitting 62, shown in phantom view, be cemented to pipe 40.

Figure 2:
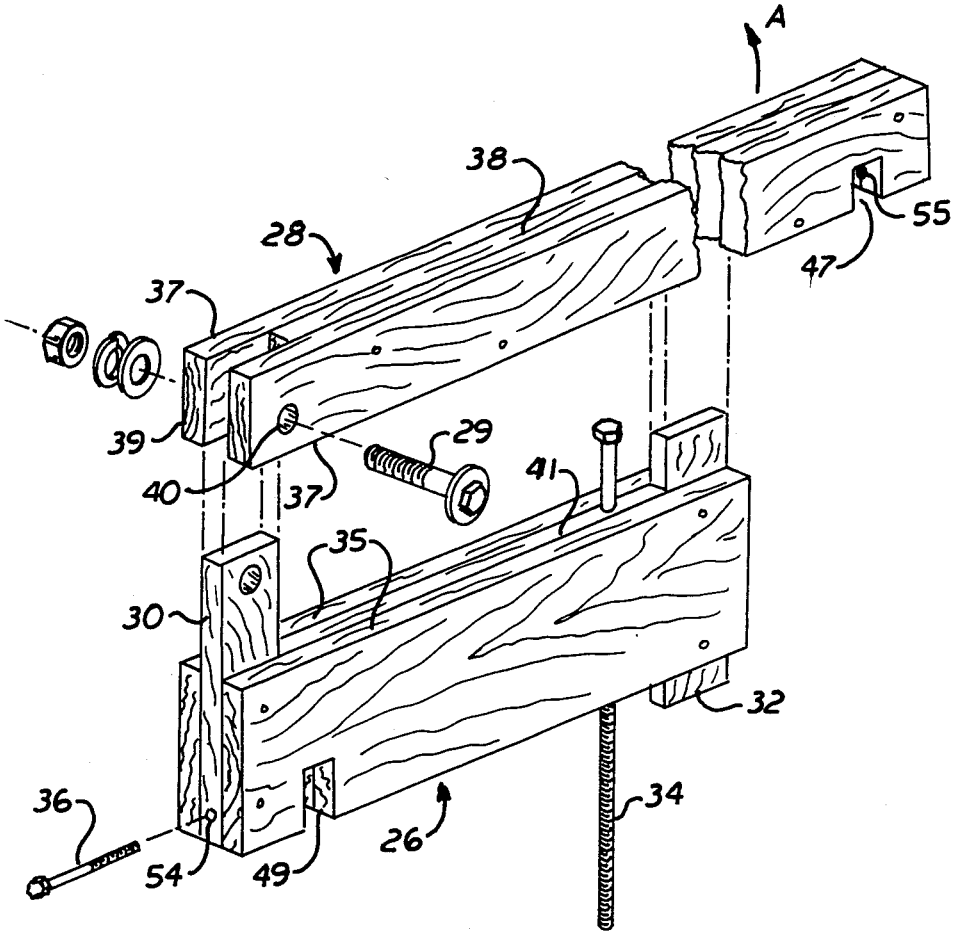
FIG. 2 is a perspective exploded view of a portion of the framing system of the invention.

The frame system comprises two major portions, a transverse framing system 6 and a set of form boards 8. The construction of framing system 6 is best seen with reference to FIG. 2. Upper frame arm 28 is preferably formed from strips of ¾ inch exterior grade plywood, although solid lumber may be utilized and other thicknesses can be used. Two outer strips 37 have an inner strip 38 sandwiched therebetween leaving a slot 39 in the inner end thereof. A notch 47 is cut in the outer end thereof. A longitudinal hole 53 is drilled from the end of arm 28 into notch 47 and a tee nut 55 installed as seen from FIG. 1. Strips 37 and 38 may be glued and nailed together to make a unitary structure. Lower frame arm 26 is of similar construction being laminated from three pieces of exterior grade plywood 35 and 41. An inner vertical member 30 is provided which fits into slot 39 and is bolted to brace 28 by means of bolt 29. As will be understood, bolt 29 is installed permanently which will allow upper frame arm 28 to swing upward as indicated by arrow A during installation of framing system 6. At the outer end of lower frame arm 26, a vertical member 32 is provided which butts against the lower edge of upper frame arm 28. A notch 49 is cut in the inner end of lower frame arm 26. A long support machine bolt 34 is disposed vertically through a hole in center portion 41.

The form system of the invention utilizes three longitudinal form boards: waterline form board 20; inner curb form board 22 and outer curb form board 24. A typical straight section form board 20, styrofoam panel 16, and tiles 10 are shown in exploded view in FIG. 3. Preferably, form board 20 is formed from exterior grade ¾ inch plywood. Styrofoam panel 16 is then attached to form board 20 with staples or nails. A strip of double sided adhesive tape 15 is attached to a rabbeted area 51 of styrofoam panel 16. Ceramic tiles 10, which will become the waterline tiles of the finished pool, are later aligned in rabbet 51 with the finished side attached to the outer surface of adhesive tape 15 with the required space for grout left between tiles 10. It is to be understood that three tiles 10 are shown for exemplary purposes in FIG. 3 but that in use, the entire panel 16 will be aligned with tiles.

Figure 3:
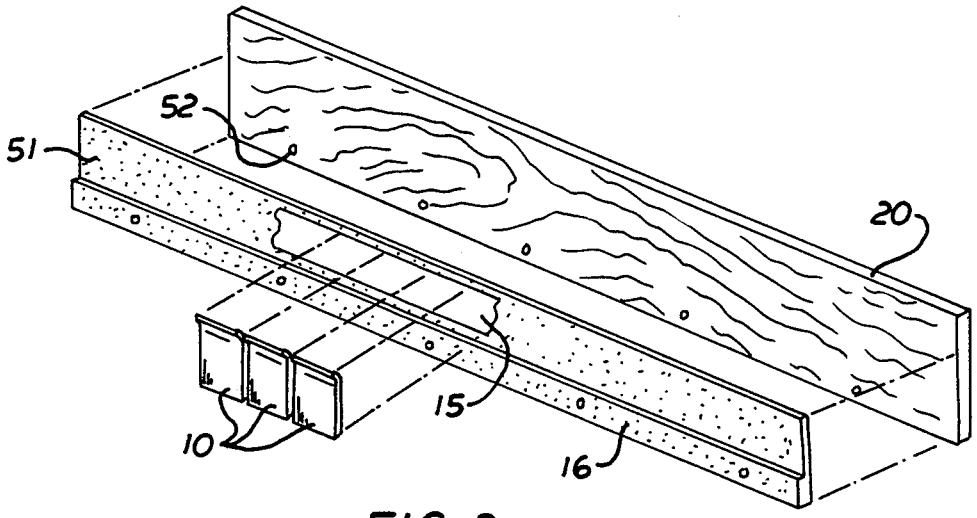
FIG. 3 is a perspective exploded view of a form board used in the form system of the invention showing the manner in which tiles are attached thereto.
Figure 4:
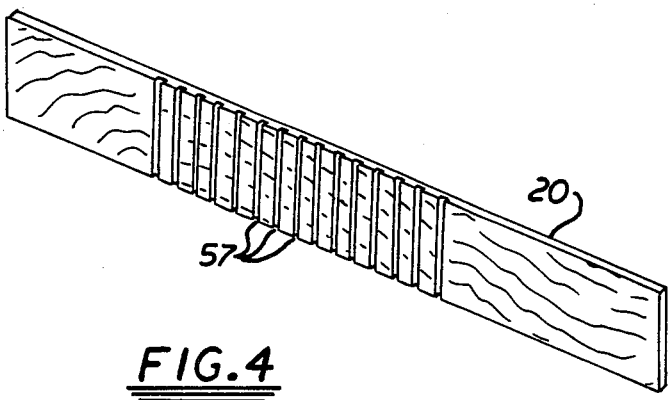
FIG. 4 is a perspective view of a form board of the invention for use in curved portions of a swimming pool under construction.

Inner curb panel board 22 and outer curb panel board 24 are similar to that of FIG. 3 with the exception that water line form board 20 includes a series of holes 52 which are used in attaching form board 20 to swimming pool sidewall 11 by concrete screws 50. FIG. 4 illustrates a waterline form board 20 modified to be used in a curved portion of a swimming pool under construction. As will be noted a series of parallel vertical grooves 57 is sawed in one face of the form board 20. This permits form board 20 to be bent in a curve as required.

Having described the elements of the framing system 6 and the form boards 8, the assembly of these elements will be described with reference to FIG. 1. The first step is to staple styrofoam panel 16 to sidewall 11 and thereafter install waterline form board 20 to sidewall 11 by means of concrete screws 50. The upper part of styrofoam panel 16 is then stapled to form board 20. To provide additional bracing, a steel strap 45 is tacked to the upper edge of form board 20 and to the outer edge of swimming pool wall 11 by means of concrete nails 46. Straps 45 are appropriately installed along the length of the form boards 20.

Framing structure 6 is installed with notch 49 engaging the upper edge of form board 20. Upper frame arms 28 are swung upward to an essentially vertical position. Bolts 34 which are threaded through T-nuts 31 bear against the top edge of sidewall 11 and are adjusted to level lower frame arm 26. Next, inner curb form boards 22 having styrofoam panels 18 attached thereto are nailed to the inner end of lower frame arm 26 with the upper edges level with the lower edges of upper frame arms 28 when in a level position.

Prior to installing outer curb form board 24, reinforcing steel 43 may be installed and tied to sidewall rods 41. As will be recognized, having upper frame arms 28 swung upward permits clear access to the area of reinforcing steel 43. Outer curb form boards with styrofoam panel 20 in place are installed and upper frame arms 28 swung down and notches 47 engaged with the top edges of form boards 24. Stakes 25 are driven into ground 13 along form boards 24 to provide additional support. Bolts 35 and 36 threaded through T-nuts 55 are tightened to secure form boards 20 and 24 in place.

It will be noted that frame system 6 acts as an accurate spacing device in addition to serving as concrete form supports. For example, styrofoam panel 16 defines the level of the waterline edge of the gutter and the lower edge of inner curb form board 22 defines the level of the curb edge of the gutter. Lower frame arm 28 sets the spacing of the gutter and inner curb, while upper frame arm 28 defines the spacing between the inner curb line and the outer curb line. Therefore, a complete form system can be installed with a minimum of measuring to produce a perfectly uniform installation.

After completion of the form system installation, tiles 10, 12, and 14 are installed above the rabbeted areas of styrofoam panels 16, 18, and 20 being held in place by double sided adhesive tapes 15. In FIG. 1, concrete has been poured to form bond beam 5 and will adhere to the unfinished sides of tiles 10, 12 and 14. The concrete between the waterline forms 20 and tiles 10 outward to the inner curb area defined by forms 22 and tiles 12 will form the gutter portion of the pool. The concrete between inner curb forms 22 and tiles 12 and outer curb form 24 and tiles 14 will form the curb portion. After the bond beam concrete has cured, the framing 6 and the form boards 8 are removed and the adhesive tapes 15 peeled away from the faces of tiles 10, 12 and 14. Braces 45 are cut off level with the gutter portion of concrete 5. The openings left by bolts 34 may be patched and the desired concrete finish coats such as marcite applied to the gutter areas and the curb areas. After applying the finish coat to the pool sidewalls 11, grout may be installed between the tiles.

Figure 5:
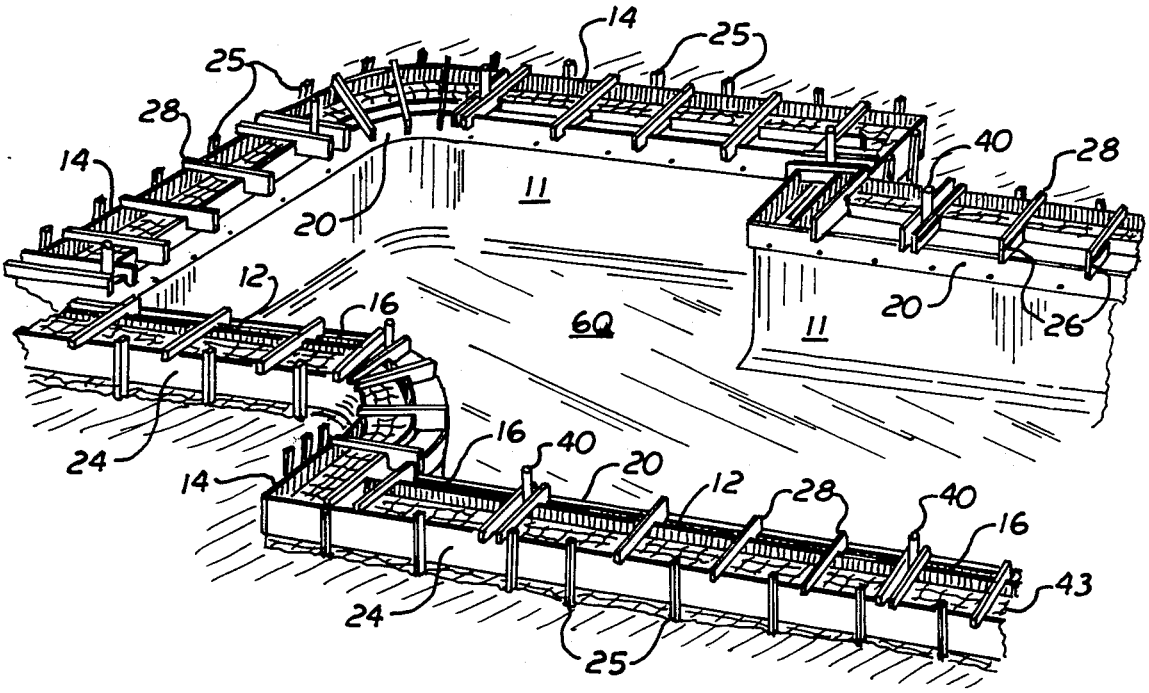
FIG. 5 is a perspective view of a part of a swimming pool under construction showing the form system of the invention in place.

Turning to FIG. 5, a perspective view of a pool having straight sides and square corners as well as interior and exterior curved corners is shown in which the concrete floor 60 and sidewalls 11 have been produced and cured. The form system of the invention has been installed. The curved form boards are provided utilizing the scored forms as indicated in FIG. 4. The distribution of stakes 25 which provide support for curb forms 24 may also be noted.

As will be recognized, a novel form system for pouring a concrete bond beam gutter and curb for a swimming pool and simultaneously bonding tiles to the edges of the bond beam has been disclosed and the method of producing the bond beam, gutter and curb with tiles in place has been defined. Although a particular design and configuration of the form system has been described, the details of the system are for exemplary purposes only and many variations, modifications and arrangements may be made without departing from the spirit and scope of the invention.

I claim:

1. In a swimming pool having concrete sidewalls, a form system for pouring a concrete bond beam, gutter and curb contiguous with said sidewalls and simultaneously bonding tiles to the edges of said bond beam comprising:

(a) a set of elongate form boards having
  (i) a first form board attached to said sidewall for defining the waterline edge of said bond beam and gutter,
  (ii) a second form board disposed outboard and spaced apart from said first form board for defining an outer edge of said gutter, and
  (iii) a third form board disposed outboard and spaced apart from said second form board for defining an outer edge of said curb;

(b) a set of tile holding panels in which
  (i) a first of said panels is attached to an outboard face of said first form board,
  (ii) a second of said panels is attached to an outboard face of said second form board, and
  (iii) a third of said panels is attached to an inboard face of said third form board;

(c) adhesive means disposed on and along the exposed surface of each of said panels for receiving a finished surface of the tiles to thereby temporarily attach the tiles to said panels; and (d) a plurality of form board support members disposed over and essentially transverse to said set of form boards, said support members temporarily attached to said first, second, and third form boards for supporting said set of form boards in a first preselected spacing between said first form board and said second form board, and a second preselected spacing between said second form board and said third form board.

2. The system as defined in claim 1 which further includes a plurality of stakes disposed along an outer surface of said outer curb form boards for providing support thereto.

3. A bond beam, gutter and curb form system for use in construction of a swimming pool having concrete sidewalls and having a plurality of tiles defining the exposed surfaces of the pool gutter and curb, said form system comprising:

a plurality of elongate waterline form boards temporarily attached along the inner upper edge of said sidewalls, said waterline form boards including first elongate panels disposed along the outer faces thereof, said first panels having rabbetted areas thereof essentially the thickness of the tiles, and adhesive means disposed on and along each of said areas for receiving a finished surface of the tiles to thereby temporarily attach waterline tiles to said first panels;

a plurality of elongate inner curb form boards spaced apart from said waterline form boards thereby defining an inner line of the curb, said inner curb form boards including second elongate panels disposed along the outer faces thereof, said second panels having rabbetted areas thereof essentially the thickness of the tiles, and adhesive means disposed on and along each of said areas for receiving a finished surface of the tiles to thereby temporarily attach inner curb tiles to said second panels;

a plurality of elongate outer curb form boards spaced apart from said inner curb form boards thereby defining an outer line of the curb, said outer curb form boards including third elongate panels disposed along the inner faces thereof, said third panels having rabbetted areas thereof essentially the thickness of the tiles, and adhesive means disposed on and along each of said areas for receiving a finished surface of the tiles to thereby temporarily attach outer curb tiles to said third panels; and a plurality of support frame members disposed over and essentially transverse to said waterline, inner curb, and outer curb form boards and attached thereto for support of said form boards and for maintaining said form boards with a preselected spacing therebetween;

whereby concrete poured between said form boards forms a bond beam, curb and gutter and adheres to the waterline tiles and the inner and outer curb tiles.

4. The system as defined in claim 3 in which said first, second and third elongate panels are each expanded foam panels.

5. The system as defined in claim 3 in which said support frame member includes:

an upper frame arm having a length greater than the spacing between said water line form board and said outer curb form board;

a lower frame arm having a length greater than the spacing between said water line form board and said inner curb form board, said upper support arm and said lower support arm having inner ends thereof essentially aligned, said inner end of said upper support arm pivotally attached to said inner end of said lower support arm;

said lower support arm having a first notch therein adjacent to said inner end thereof, said notch adapted to engage a top edge of said waterline form board and said outer end of said upper support arm having a second notch engaging the upper edge of said outer curb form board, and said inner curb form board is attached to an inner end of said lower support arm.

6. The system as defined in claim 5 in which said lower support arm includes an adjustable bolt therethrough for resting on an upper edge of said sidewall, said bolt adjustable to level said lower support arm.

7. The system as defined in claim 5 in which said first and second notches include clamping bolts disposed in said inner end of said lower support arm and in said outer end of said upper support arm, said clamping bolts for clamping said upper and lower support arms to said form boards.

8. The system as defined in claim 3 in which said adhesive means is double sided adhesive tape.

* * * * *